US005355054A

United States Patent [19]

Van Lierop et al.

[11] Patent Number: 5,355,054

[45] Date of Patent: Oct. 11, 1994

[54] ELECTRODELESS LOW-PRESSURE DISCHARGE LAMP HAVING A COOLING BODY WITH A PARTITIONED VAPOR CHANNEL

[75] Inventors: Dirk F.W. Van Lierop; Herman H.M. Van der Aa; Nico H.J. Van de Peppel, all of Eindhoven, Netherlands

[73] Assignee: U.S. Philips Corporation, New York, N.Y.

[21] Appl. No.: 996,239

[22] Filed: Dec. 23, 1992

[30] Foreign Application Priority Data

Jan. 7, 1992 [XH] Hague ..... 92200027.8

[51] Int. Cl.[5] ..... H05B 41/24; H01J 61/52; H01J 1/50

[52] U.S. Cl. ..... 315/112; 315/248; 315/344; 313/11; 313/12; 313/35; 313/46

[58] Field of Search ..... 315/50, 112, 248, 344, 315/358; 313/161, 34, 44, 45, 46, 493, 11, 12, 17, 20, 22, 24, 33, 35, 37

[56] References Cited

U.S. PATENT DOCUMENTS 2,800,605 7/1957 Marchese ..... 315/50
5,006,752 4/1991 Eggink et al. ..... 313/161
5,291,091 3/1994 Eggink et al. ..... 315/248 X

*Primary Examiner*—David Mis
*Attorney, Agent, or Firm*—Brian J. Wieghaus

[57] ABSTRACT

An electrodeless low-pressure discharge lamp having a sealed discharge vessel filled with a metal and a rare gas and having a cavity. An inductive device is disposed in the cavity for generating a high-frequency electric field inside the discharge vessel during lamp operation. The inductive device includes a winding of metal wire surrounding a cylindrical core of magnetizable material. A cooling body is in contact with the cylindrical core for removing heat generated in the core during lamp operation. The cooling body is closed in a gastight manner and includes a condenser, an evaporator, a liquid, and a capillary structure (T, U) which comprises a winding (U) of gauze surrounding a vapor channel (V) for transporting the liquid from the condenser to the evaporator. The capillary structure has a central partition wall (T), which divides the vapor channel in two, and is connected along two opposing longitudinal sides thereof to the gauze winding (U). The cooling body has very good cooling properties, so that the electrodeless low-pressure discharge lamp has a high luminous efficacy.

16 Claims, 1 Drawing Sheet

ELECTRODELESS LOW-PRESSURE DISCHARGE LAMP HAVING A COOLING BODY WITH A PARTITIONED VAPOR CHANNEL

BACKGROUND OF THE INVENTION

The invention relates to an electrodeless low-pressure discharge lamp having

- a radiation-transmitting discharge vessel which is sealed in a gastight manner and is filled with a metal and a rare gas, which discharge vessel includes a cavity,
- a circuit arrangement for generating a high-frequency current during lamp operation,
- inductive means in the cavity of the discharge vessel during lamp operation and are coupled to the circuit arrangement, the inductive means including a winding of metal wire surrounding a cylindrical core of magnetizable material for generating a high-frequency electric field inside the discharge vessel from the high-frequency current during lamp operation, and
- a cooling body in contact with the cylindrical core for the removal of heat generated in the cylindrical core during lamp operation, the cooling body including a vessel which is closed in a gaslight manner and comprises a condenser, an evaporator, a liquid, and a capillary structure which comprises a winding of gauze surrounding a vapour channel for transporting the liquid from the condenser to the evaporator.

The invention also relates to a cooling body for use in such an electrodeless low-pressure discharge lamp.

Such an electrodeless low-pressure discharge lamp is known from Netherlands Patent 8900406.

The cooling body removes part of the heat generated in the cylindrical core and in the plasma of the electrodeless low-pressure discharge lamp during lamp operation.

As a result, the temperature of the wall of the cavity and the temperature of the cylindrical core remain comparatively low, so that power losses are limited. The heat absorbed by the cooling body is absorbed for the major part by the liquid, which evaporates as a result. This process takes place in the evaporator. The created vapour condenses in the condenser, so that heat is transferred to the condenser. The condensed liquid is then transported to the evaporator, so that there is a continuous circulation of liquid in the cooling body. Especially if the evaporator is arranged above the condenser, the transport from condenser to evaporator takes place mainly through capillary channels in the capillary structure formed from gauze. In addition to the capillary channels in the gauze itself, capillary channels may be formed inter alia between the wall of the gastight vessel of the cooling body and the gauze. If the capillary structure is built up from more than one layer of gauze, capillary channels may also be formed between layers of gauze. It is necessary for the formation of these capillary channels that the gauze lies securely against the wall of the cooling body, and that the various gauze layers lie securely against one another, as applicable. A good contact between the wall of the cooling body and the gauze also promotes the transfer of heat from the evaporator wall to the liquid transported by the capillary structure. In practice, the capillary structure is often obtained in that the gauze is rolled up so as to form a winding, and the gauze winding is inserted into the cooling body. It was found that a good contact between the gauze and the wall of the cooling body, and between the different layers of gauze lying against one another in the cooling body of the known electrodeless low-pressure discharge lamp is often not realised. As a result, the cooling properties of the cooling body are comparatively bad and at the same time poorly reproducible.

SUMMARY OF THE INVENTION

The invention has for its object inter alia to provide an electrodeless low-pressure discharge lamp provided with a cooling body which has comparatively good and reproducible cooling properties.

According to the invention, this object is achieved in that an electrodeless low-pressure discharge lamp of the kind mentioned in the opening paragraph is provided with a cooling body in which the capillary structure also comprises a central partition wall which divides the vapour channel in two and is connected to the gauze winding at two opposing longitudinal sides of the partition wall.

It was found that the resulting cooling body has very good cooling properties, so that the luminous efficacy of the electrodeless low-pressure discharge lamp reaches a comparatively high value. It was also found that the cooling properties of the cooling body are well reproducible, so that it is possible to manufacture electrodeless low-pressure discharge lamps according to the invention of a substantially constant quality.

An advantageous embodiment of an electrodeless low-pressure discharge lamp according to the invention is characterized in that the thickness of the gauze winding is more than three hundredths and less than one tenth of the diameter of the vapour channel. Since the gauze winding has a low heat conduction coefficient in a direction perpendicular to the winding, the cooling properties of the cooling body are adversely affected by a comparatively thick gauze winding. A comparatively thin winding, however, adversely affects the liquid transport from the condenser to the evaporator, by which the cooling properties of the cooling body are also adversely affected. It was found that favourable cooling properties can generally be obtained when the thickness of the gauze winding is related to the diameter of the vapour channel in the way indicated above.

A further embodiment of an electrodeless low-pressure discharge lamp according to the invention is characterized in that the capillary structure is formed from one strip of gauze. Since in this further embodiment the central partition wall is formed from one and the same strip of gauze as the winding, the capillary structure of the cooling body of this further embodiment may be manufactured by means of a comparatively simple process.

Another embodiment of an electrodeless low-pressure discharge lamp according to the invention is characterized in that the capillary structure comprises capillary channels which are bounded inter alia by the central partition wall and the winding. These channels serve as a reservoir for the liquid. Because of the comparatively bad heat conduction of the liquid, it is undesirable for comparatively large quantities of liquid to be present in the cooling body outside the capillary structure. If, however, capillary channels are formed between the central partition wall and the gauze winding, any excess liquid present is stored in the capillary channels, so that the cooling properties of the cooling body are not adversely affected. These capillary channels may be provided in a simple manner in the further embodiment of an electrodeless low-pressure discharge lamp according to the invention described above in that the radius of curvature of the gauze strip in the vicinity of the transition between the central partition wail and the winding is suitably chosen.

BRIEF DESCRIPTION OF THE DRAWINGS

An embodiment of the invention will be explained in more detail with reference to a drawing, in which FIG. 1 diagrammatically shows an embodiment of an electrodeless low-pressure discharge lamp according to the invention, partly in elevation, partly in cross-section.

DESCRIPTION OF THE PREFERRED EMBODIMENT

Figure 1:
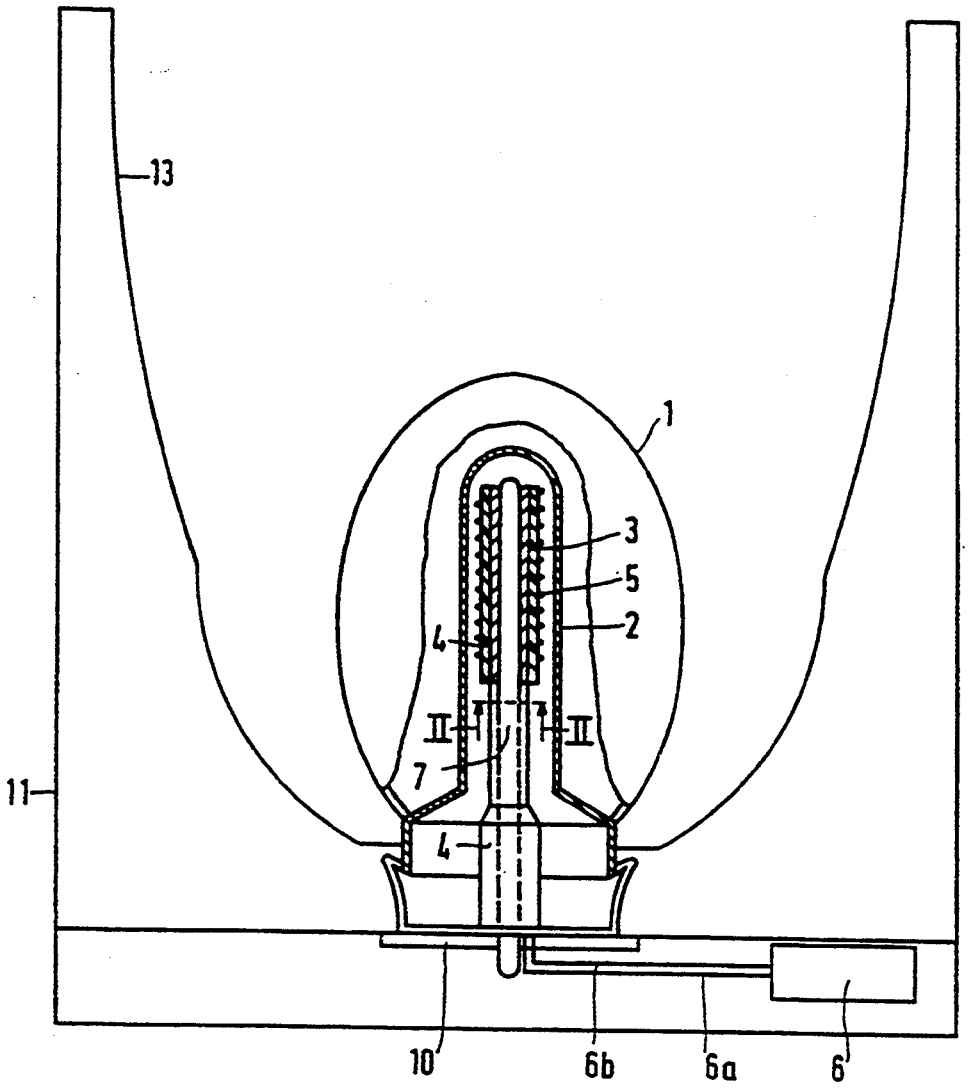

FIG. 1 shows a discharge vessel 1 which is sealed in a gastight manner and is filled with mercury vapour and a rare gas. The inside wall of the discharge vessel is provided with a luminescent layer for converting ultraviolet radiation generated in the discharge into visible light. The discharge vessel is provided with a cavity 2. A cylindrical core 3 of magnetizable material is present in the cavity 2. The cylindrical core 3 is surrounded by a cylinder 4 made of a synthetic resin and provided on the outside with a winding 5 of metal wire. Conducting wires *6a* and *6b* connect ends of the winding 5 to a circuit arrangement 6 which generates a high-frequency current during lamp operation. Reference numeral 7 denotes a cooling body provided with a gastight vessel which is partly surrounded by the cylindrical core and which is in contact with this cylindrical core. The wall of the gastight vessel is in contact with a gauze winding which forms a capillary structure over the entire length of the cooling body. A liquid is also present in the gastight vessel. Reference numeral 10 denotes a metal flange fastened to the cooling body and to the wail of a metal housing 11. A reflector has reference numeral 13. The portion of the wail of the cooling body which is in contact with the cylindrical core forms the evaporator. Condensation of the liquid takes place mainly on the portion of the wail adjacent the metal flange 10. This latter portion of the wall forms the condenser.

The operation of the electrodeless low-pressure discharge lamp shown in FIG. 1 is as follows. During lamp operation, the circuit arrangement 6 generates a high-frequency current which flows through the winding of metal wire. This generates a high-frequency electric field which causes a discharge in the discharge vessel. Radiation is generated in this discharge, mainly ultraviolet radiation. This ultraviolet radiation is converted into visible radiation by the luminescent layer. Liquid circulates in the gastight vessel of the cooling body in that it first evaporates in the evaporator, is transported through the vapour channel to the condenser, condenses in the condenser, and is finally transported to the evaporator through the capillary structure. Heat generated in the cylindrical core is removed to the metal flange 10 mainly by means of the liquid circulation taking place in the gastight vessel of the cooling body. This heat is transferred through the metal flange 10 to the wall of the metal housing 11.

Figure 2:
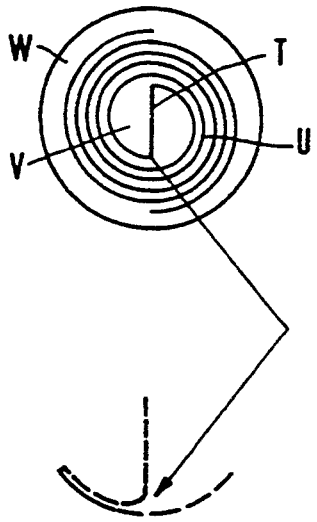
FIG. 2 shows a cross-section of a cooling body which forms part of the electrodeless low-pressure discharge lamp of FIG. 1.

FIG. 2 is a diagrammatic cross-section of the cooling body taken on the plane II in FIG. 1. W is the wall of the gastight vessel of the cooling body. U is a gauze winding. In the embodiment shown, the winding comprises three layers of gauze. T is a central partition wall which divides the vapour channel V, surrounded by the winding U, in two. The central partition wall T and the winding U are formed from one strip of gauze, so the partition wall is integrally connected along both opposing longitudinal sides thereof with the gauze winding. Capillary channels are formed at the locations where the central partition wall merges into the winding. The cross-section of one of these channels is shown in broken lines in FIG. 2. Owing to the presence of the central partition wall T, there is a good contact between the layers of gauze and between the outermost gauze layer and the wall W of the gastight vessel of the cooling body. Thanks to this good contact, there is a comparatively good heat transfer in the radial direction, while at the same time the capillary structure comprises a sufficiently large number of capillary channels for achieving an effective transport of the liquid from the evaporator to the condenser, so that the cooling body has good cooling properties. It is achieved by the good cooling properties of the cooling body that power losses in the cylindrical core remain limited, so that the electrodeless low-pressure discharge lamp has a comparatively high luminous efficacy.

In a practical implementation of the embodiment discussed, a cylindrical cooling body was used consisting of a copper tube having an external diameter of 6 mm and a wall thickness of 1 mm. The cylinder was sealed up at both ends. The capillary structure was formed by means of a single strip of gauze woven from metal wire of 35 $\mu$m diameter. The gauze winding comprised three layers of gauze. Water was used as the liquid. It was found that the heat conduction coefficient of this cooling body was approximately twenty times higher than that of a cooling body constructed as a solid copper cylinder of the same external dimensions.

We claim:

1. An electrodeless low-pressure discharge lamp comprising

- a radiation-transmitting discharge vessel which is sealed in a gastight manner and is filled with a metal and a rare gas, the discharge vessel including a cavity,
- inductive means disposed in the cavity of the discharge vessel for generating a high-frequency electric field inside the discharge vessel during lamp operation, said inductive means comprising a core of magnetizable material and a winding of metal wire surrounding the core of magnetizable material, and
- a cooling body in contact with the core for removal of heat generated in the core during lamp operation, the cooling body comprising a vessel which is closed in a gastight manner and including a condenser, an evaporator, a liquid, and a capillary structure which comprises a winding of gauze defining a vapor channel for transporting the liquid from the condenser to the evaporator, characterized in that:

the capillary structure also comprises a central partition wall which divides the vapor channel in two and includes two opposing longitudinally extending sides connected to the gauze winding.

2. An electrodeless low-pressure discharge lamp as claimed in claim 1, characterized in that the thickness of the gauze winding is more than three hundredths and less than one tenth of the diameter of the vapour channel.

3. An electrodeless low-pressure discharge lamp as claimed in claim 2, characterized in that the capillary structure comprises only one strip of gauze.

4. An electrodeless low-pressure discharge lamp as claimed in claim 3, characterized in that the capillary structure comprises capillary channels which are bounded by the central partition wall and the gauze winding.

5. An electrodeless low-pressure low-pressure discharge lamp as claimed in claim 2, characterized in that the capillary structure comprises capillary channels which are bounded by the central partition wall and the gauze winding.

6. An electrodeless low-pressure low-pressure discharge lamp as claimed in claim 1, characterized in that the capillary structure comprises capillary channels which are bounded by the central partition wall and the gauze winding.

7. An electrodeless low-pressure discharge lamp as claimed in claim 1, characterized in that the capillary structure comprises only one strip of gauze.

8. An electrodeless low-pressure discharge lamp as claimed in claim 7, characterized in that the capillary structure comprises capillary channels which are bounded by the central partition wall and the gauze winding.

9. A cooling body for use in an electrodeless low-pressure discharge lamp, said cooling body comprising:

a vessel which is closed in a gastight manner and comprises a condenser, an evaporator, a liquid, and a capillary structure, the capillary structure comprising a winding of gauze forming a vapor channel for transporting the liquid from the condenser to the evaporator and including a central partition wall which divides the vapor channel in two and includes two longitudinally extending sides connected to the gauze winding.

10. A cooling body as claimed in claim 9, characterized in that the thickness of the gauze winding is more than three hundredths and less than one tenth of the diameter of the vapour channel.

11. A cooling body as claimed in claim 10, characterized in that the capillary structure comprises only one strip of gauze.

12. A cooling body as claimed in claim 11, characterized in that the capillary structure comprises capillary channels bounded by the central partition wall and the gauze winding.

13. A cooling body as claimed in claim 10, characterized in that the capillary structure comprises capillary channels bounded by the central partition wall and the gauze winding.

14. A cooling body as claimed in claim 9, characterized in that the capillary structure comprises capillary channels bounded by the central partition wall and the gauze winding.

15. A cooling body as claimed in claim 9, characterized in that the capillary structure comprises only one strip of gauze.

16. A cooling body as claimed in claim 15, characterized in that the capillary structure comprises capillary channels bounded by the central partition wall and the gauze winding.

* * * * *